United States Patent [19]

Geney

[11] 4,350,092

[45] Sep. 21, 1982

[54] PARALLEL-WHEEL PRINTERS

[75] Inventor: Christian Geney, Clichy, France

[73] Assignee: SMH-Adrex, Paris, France

[21] Appl. No.: 150,906

[22] Filed: May 19, 1980

[30] Foreign Application Priority Data

May 28, 1979 [FR] France ..... 79 13444

[51] Int. Cl.[3] ..... B41J 1/44

[52] U.S. Cl. ..... 101/99; 101/110; 101/93.22

[58] Field of Search ..... 101/93.29, 93.34, 93.22, 101/95, 96, 99, 110

[56] References Cited

U.S. PATENT DOCUMENTS

| | | | |
|---|---|---|---|
| 2,350,454 | 6/1944 | Goebel | 101/99 |
| 3,366,045 | 1/1968 | Canarutto et al. | 101/93.29 |
| 3,561,675 | 2/1971 | Wolf et al. | 235/61 |
| 3,693,545 | 9/1972 | Kondus et al. | 101/110 X |
| 3,872,789 | 3/1975 | Ambrosio | 101/93.29 |
| 4,141,291 | 2/1979 | Hata et al. | 101/99 |
| 4,182,240 | 1/1980 | Mitsui et al. | 101/99 |
| 4,257,324 | 3/1981 | Stefansson | 101/99 X |

FOREIGN PATENT DOCUMENTS 2391075 12/1978 France .

OTHER PUBLICATIONS

Martino, IBM Tech. Discl. Bulletin, vol. 19, No. 7, 12/76 pp. 2653–2654.

*Primary Examiner*—Edward M. Coven
*Attorney, Agent, or Firm*—Kenyon & Kenyon

[57] ABSTRACT

A compact print wheel position sensing device for parallel-wheel printers includes pairs of optoelectronic printed circuit emitters 22 and receivers 24 arranged in two lines inside and outside, respectively, a tubular shaft 21 provided with radial holes 23 aligned with each emitter/receiver pair and carrying wheels 19 which mesh with corresponding parallel print wheels 11. Each wheel 19 has a set of angularly spaced transparent regions, alternating with opaque regions, which permit transmission between the corresponding emitter/-receiver pair at each printing position of the respective print wheel. A logic device includes a memory arranged for storing printing wheel position orders and having double reading heads for each division. A double electronic switch is connected to the heads to read the divisions in numerical sequence, each division being read twice per cycle, the earlier reading head controlling electromagnetic latches for stopping each print wheel at the ordered position and the later reading head subsequently delivering the order signal for comparison with the resulting wheel position, thereby compensating for mechanical actuation delay of said electromagnetic latches.

6 Claims, 4 Drawing Figures

PARALLEL-WHEEL PRINTERS

Figure 1:
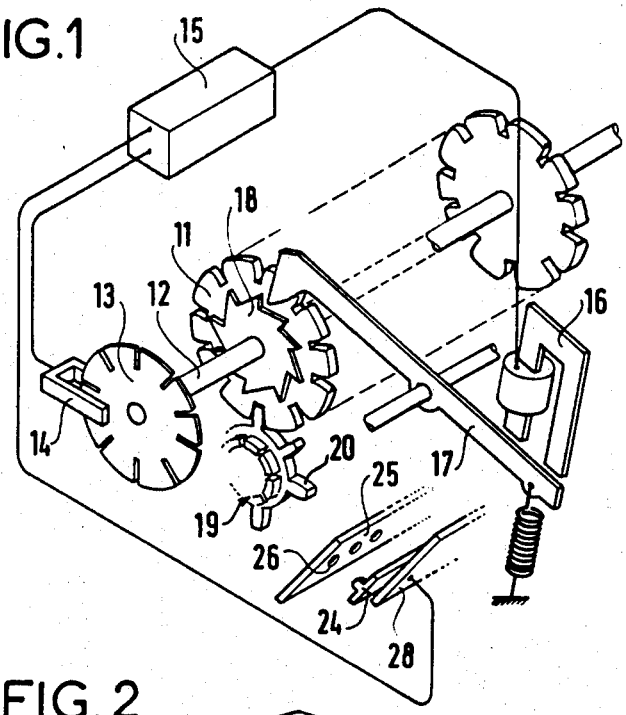

The invention relates to a printer with print wheels.

The print wheels are rotated in one direction by a drive shaft during the position selection phase, there being means for releasing each wheel from the shaft so that the wheel may be stopped during the rotation of the shaft. Electro-magnets which change state during said selection sequence on receiving an order from an external logic unit release a lever which is arranged so that it stops the print wheel in the required position; after printing, the rotation direction of the drive shaft is reversed, and particular connection means between the shaft and the wheels cooperate to return the set of wheels to the rest position.

Various embodiments of such print wheel control means are known whose writing speed, while not being that required for high-performance equipment, is sufficient for numerous applications: calculating machines, cash registers, result registers. However, these mechanisms cannot be relied on with sufficient certainty to give a printed result which corresponds to the order emitted. As mentioned above, the order pulse for stopping the movement of a wheel is generated by a computer, starting from an order outside the printing arrangement and triggered from data delivered by a sensor which detects the position of the wheel drive shaft to change the state of the electro-magnet which stops the wheel.

Said sensor is generally fixed on the drive shaft itself and is therefore supposed to represent the position of a rotating wheel.

Now, several types of failure may occur which will cause misprints if no extra control means are provided. Faulty sensor positions (slots stopped, light interference in particular in opto-electronic sensors) cause false data to be supplied to the control unit, or faulty driving of the print wheels makes the position of the wheels no longer correspond to the state of the drive shaft position sensor.

These non-exhaustive examples show that these mechanisms can print values which are not those of the order entered.

In another respect, unless particular dispositions are made, a wheel position detection unit installed in a printing mechanism of this type has dimensions which are incompatible with usual spacing between two adjacent print wheels. Indeed, conventional detection units are disposed in several rows round the wheel or in several rows round an intermediate counter gear associated with the wheel.

The present invention remedies these various drawbacks by providing detection assemblies for checking the position reached by each print wheel. This makes it possible to be certain of the compliance of the printing with the order or, if need be, to indicate a faulty selection sequence. Further, the detection assemblies are small and are disposed on a single shaft which can be directly associated with the print wheels even if there is a small gap between adjacent print wheels, in particular a gap of 1/10th of an inch (2.54 mm) in printers for documents intended for ocular reading.

The present invention provides a printer with parallel print wheels which are driven by a drive shaft and whose rotation can be stopped by an electro-magnet, said shaft rotating a slotted disk which, via a first opto-electronic sensor, indicates the position of the drive shaft, each of said print wheels rotating an associated wheel whose teeth engage in hollows in the print wheel, the shaft including second opto-electronic means, for detecting the position of the print wheel, wherein said second opto-electronic means are constituted by radiation emitters disposed inside a fixed tube provided with holes along its generatrix and supporting said associated wheels which include transparent portions which alternate with portions which are opaque to said radiation and by receivers which are sensitive to the radiation and are disposed outside said associated wheels, each receiver being disposed facing the emitter-hole alignment.

According to one particularly advantageous feature of the invention, said emitters and/or said receivers of radiation are disposed on printed circuit strips.

According to another feature, the printer is provided with first electronic comparison means for comparing a reference signal stored in a memory register and read by an electronic switch with data coming from said first and second opto-electronic means, said first means serving to indicate a fault, and second electronic control means for controlling said electro-magnet starting from the reference signal stored in said memory register, and said switch allows simultaneous double reading of any division of said register, to supply said first comparison means, and of a following division of said register, to feed said second control means, so as to compensate for the time delay in actuating said electro-magnet.

The invention is described hereinafter by way of example and with reference to one embodiment, said example being given by way of illustration and having no limiting character, with reference to the four schematic figures in which the same components bear the same reference symbols.

Figure 2:
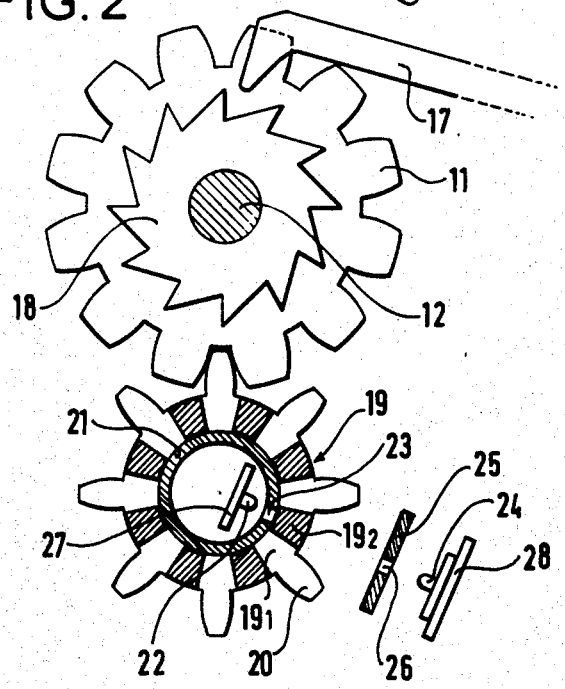
Figure 3:
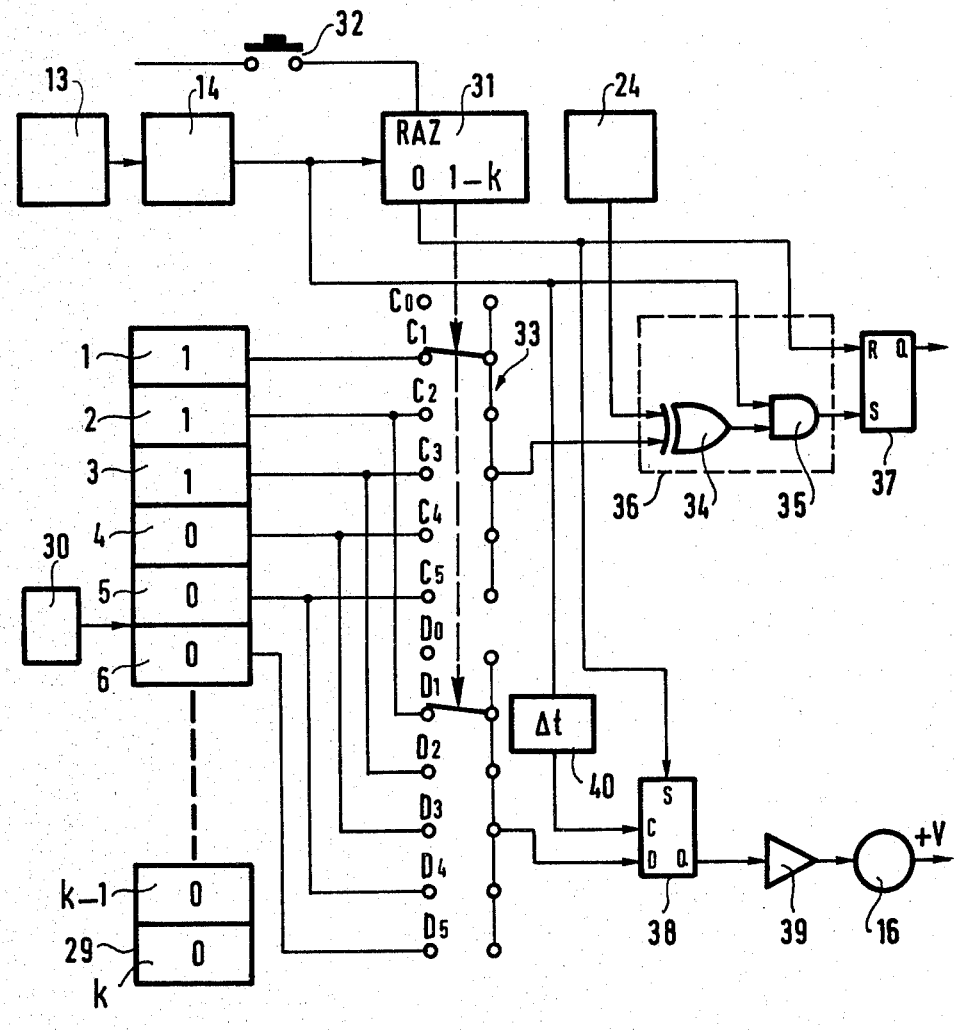
Figure 4:
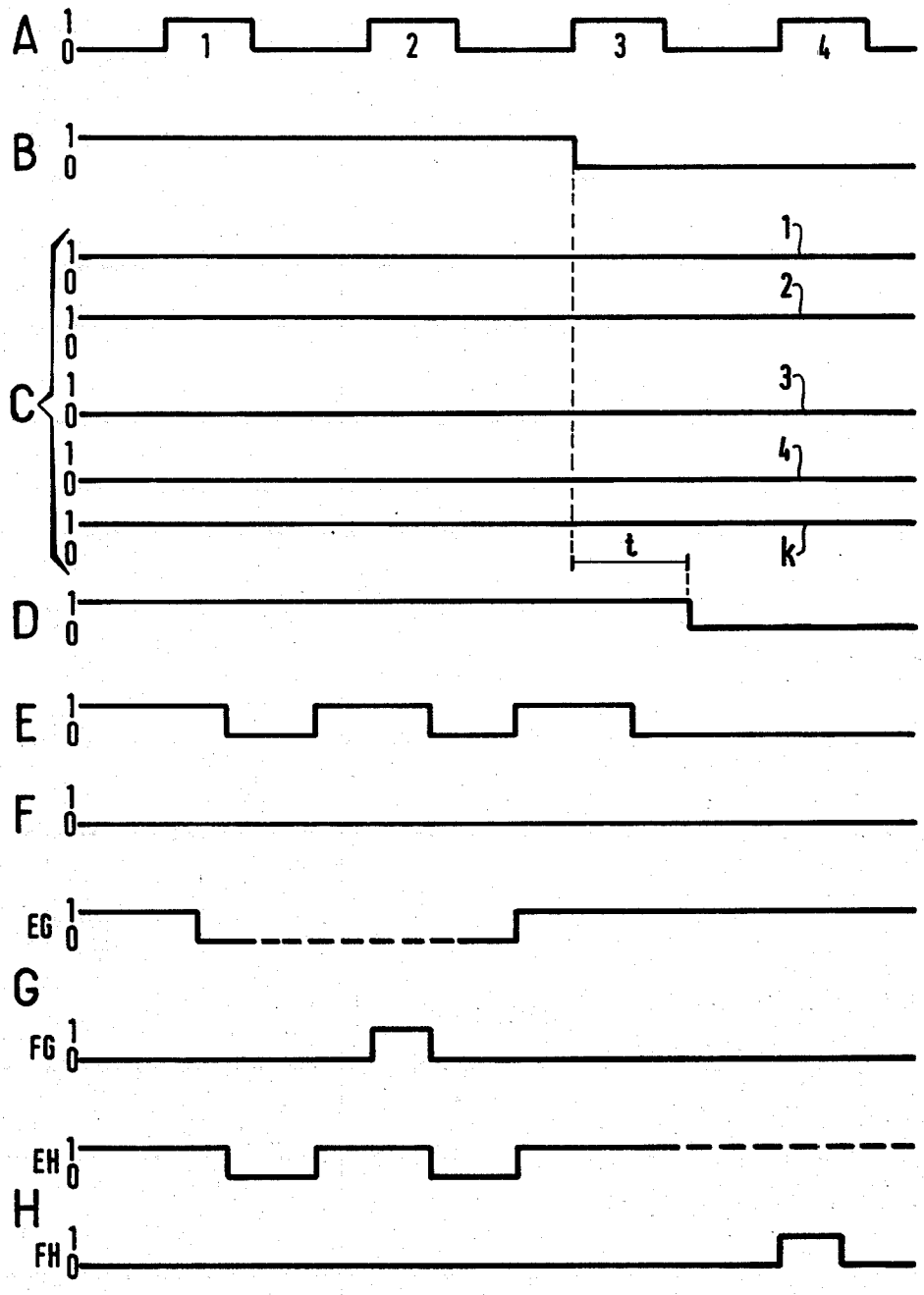

FIG. 1 is a schematic illustration of the operation principle of the printer in accordance with the invention;

FIG. 2 schematically illustrates a cross section of a print wheel and of the associated wheel of the printer of FIG. 1;

FIG. 3 is a block diagram of the logic unit of the printer of FIG. 1; and FIG. 4 shows various timing waveforms of the operation of the electronic circuit of FIG. 3.

The main components of a printing mechanism to which the invention applies are a row of printing wheels 11 fitted on a drive shaft 12. Conventional means (not shown) for releasing the shaft from the wheels are provided to make selection possible. Said means are supposed to provide positive return to the rest position, which is therefore accurately known at the beginning of each cycle.

An opto-electronic system for detecting the position of the drive shaft is shown connected directly to the drive shaft. Said system includes a slotted disk 13 associated with a sensor 14 consisting of a radiation emitting diode or lamp on one side of the disk 13 together with a receiving photo-transistor on the other side of the disk. Said assembly supplies a logic unit 15 with data concerning the position of the shaft 12. The logic unit 15 causes the electro-magnets 16 to change state, thereby causing the levers 17 to rock and to stop the rotation of the wheels by engaging the end of each lever in a cog wheel 18 which is made fast to the wheel 11. Each electro-magnet 16 as here shown when actuated draws its lever into contact with the cog wheel to stop the wheel 11. It is quite evident that the components could be organized so that the electro-magnet 16 is actuated to withdraw the lever 17 during the rotation of the wheel, with said lever being biased by a spring to engage a cog of the wheel 11 when the electro-magnet is de-energized.

A position detector is associated with each printing wheel, as shown in FIG. 2. Each print wheel 11 has a peripheral profile for driving an associated wheel 19 whose periphery has a complementary profile 20. It may be advantageous to determine the shapes of these profiles starting from involutes of a circle, in particular by generating the wheel 19 from a gear wheel on which every other space is filled with material, the profile of the associated wheel then being constituted by a gear wheel from which every other tooth is removed. However, other profile configurations may be used which provide for suitable continuity of the drive without using gear wheels which have the usual involute geometry. The associated wheel 19 rotates on a tubular shaft 21 which is fixed to the frame of the machine. A radiation emitter 22 is disposed inside the tube 21 so as to emit a beam through a hole 23 in the wall of the tube. A coincidence search receiver 24 which is sensitive to the radiation emitted by the emitter is disposed outside the tube facing the beam emitted by the emitter. A plate 25 with holes 26 acts as a diaphragm with respect to the beam received by the receiver 24. Besides the parts required to drive and rotate wheel 19 on the tubular shaft 21, the associated wheel 19 includes a part situated in the zone where the beam passes for modulating transmission of the beam towards the receiver. Said part is constituted by alternating spaces or transparent zones 191, which allow the beam to pass, and by solid portions 192, which are opaque to the beam. The pitch of these modulation alternations depends on the use for which the data is intended. The modulation zone pitch of the associated wheel 19 is equal to the drive profile pitch. Therefore, when the print wheel 11 passes from one character position to the next, it causes two changes in state of the receiver. When the print wheel 11 is stationary, the associated wheel 19 is also stopped and the receiver is no longer subjected to the modulation of the beam. It is energized or de-energized according to the arrangement which is provided between the various components when they are stopped. FIG. 2 shows such a row with the wheel stopped; the assembly is arranged so as to intercept the beam when the wheel stops. The opposite configuration could also be envisaged; however, this particular configuration is taken as an example in the following description.

The wall of the tube 21 which supports the associated wheels 19 (e.g. twenty or so wheels) has a row of holes 23. A printed circuit 27 is disposed inside the tube 21, said printed circuit supporting and feeding a row of emitters 22 positioned facing the holes 23 of the tube. The plate 25 in which holes 26 are provided acts as a diaphragm for the beam emitted towards a receiver 24. The receivers 24 are disposed in a row facing the passing axes of the beams. The receivers 24 are installed on printed circuits 28 which support them and collect the electrical data. The associated wheels 19 are installed on the tube 21, and an end shift suitably positions the modulation zones facing the passages of the beams.

The above disposition allows particularly simple construction since the addition of the position detection function in a printing mechanism entails the addition of only a single moving part for each print wheel, namely, the associated wheel 19. The lower limit of the spacing of the detection assemblies is determined by how good rotation conditions of the associated wheel on the tube are and by the manufacture limits for the rows of emitters 22 and of receivers 24. In particular, these components can be juxtaposed at a spacing of 1/10th of an inch (2.54 millimeters); individual receivers or receivers connected together in strips are commercially available. They make it possible to keep to said spacing without discontinuity, and no inherent difficulty to guiding the rotation of the associated wheel at said spacing.

The diagram in FIG. 3 is a detailed illustration of the logic unit 15 of the printer. A memory register 29 is loaded with the state words which come from the reference signal unit 30 and are stored in divisions 1, 2, . . . k. In the example chosen, the print wheel 11 stops in the third position. The first three divisions 1,2,3 receive a 1 state signal. Divisions 4 to K receive an 0 state signal.

The sensor 14 associated with the slotted disk 13 delivers a signal each time a print wheel 11 comes into a position which allows it to stop.

A counter 31, reset to zero via its "clear" terminal (RAZ) at each beginning of a cycle by turning on a switch 32, counts the signals of the sensor 14. The counter 31 has outputs 0 and 1 to k which control a double electronic switch 33 which connects together reading heads $C_1$, $C_2$, $C_3$, $C_4$, $C_5$, . . . $C_k$ and $D_1$, $D_2$, $D_3$, . . . $D_k$ of memory 29, said reading heads being connected together in such a way that $C_2$ is connected to $D_1$, $C_3$ is connected to $D_2$, etc. All of the heads C and D are read simultaneously. The heads C serve to indicate faults. The heads D serve to control the electro-magnet 16. The data coming from D is in advance with respect to that coming from C. This compensates for the delay in mechanically switching off the electro-magnet 16.

Data coming from one of the heads C reaches one of the inputs of an EXCLUSIVE OR gate 34 whose other input receives the signal coming from the coincidence search sensor 24. Thus, the EXCLUSIVE OR gate 34 makes a comparison between the reference signal unit and the coincidence search sensor 24. The output of the gate 34 is connected to one input of an AND gate 35 whose other input receives the signal of the sensor 14, thus making it possible not to take the comparison data into account except during the pulse of the sensor 14. The gates 34 and 35 constitute a comparator 36 which makes the comparison between the reference signal unit 30 and the data which comes from the sensors 14 and 24. The Q output of RS bistable 37 whose reset-to-zero input R receives the signals coming from the O output of the counter 31 and whose S input receives the signals coming from the gate 35 delivers a fault signal which is able to prevent the printer from printing e.g. the function of the bistable 37 is to store the fault data delivered by the gate 35 as soon as the signal first appears. Data coming from one of the heads $D_1$ to $D_k$ of the switch 33 is sent to the D input of a D type bistable 38 whose S input receives the O output of the counter 31 and whose (clock) input C receives the signals from the sensor 14 which are delayed by a delay component 40 whose function is to allow delayed validation of the data which comes from the switch 33. When the O output of the counter 31 is in the 1 state, it sets the Q output of the bistable 38 in the 1 state. When said Q output, which is connected to the electro-magnet 16 via an amplifier 39, is in the 1 state, the electro-magnet 16 is in the rest position. When the D input of the bistable 38 reads a 0 state and the C input receives the rising wavefront of the sensor 14, the Q output of the bistable 38 passes to the 0 state and energizes the electro-magnet 16.

In all that is set forth hereinabove, the treatment of the comparison is described for only one print wheel. In a complete printer, each memory division is filled with a word which has as many bits as there are wheels to be controlled.

FIG. 4 shows the timing waveforms for the various components of a printer constituted in accordance with the description given up till now. A slotted disk 13 supplies a signal each time a print wheel 11 is in the position which allows it to be stopped: after a response time t, when the change in state of the electro-magnet has been completed, the print wheel stops due to the action of the catch. This stops the associated wheel which no longer delivers the modulation of the signal obtained during rotation. Counting the pulses of diagram A which are supplied by the slotted disk therefore makes it possible to deduce which character will come into the printing position n if the change in state of the electro-magnet occurs upon the nth signal supplied by the slotted disk. Therefore, if the required print position is the third, the change in state of the electro-magnet will be controlled by the third signal coming from the slotted disk.

Diagram B relates to the control of the electro-magnet 16.

If the binary 1 state is assigned to the rest state of the electro-magnet in the example chosen, the 0 state is assigned to the energization state. Using the preceding convention, the state of the electro-magnet, in the example where it stops on the third printing position, is represented by:

1 at the beginning of the cycle (electro-magnet not energized)

1 when the first signal from the slotted disk passes (confirmation that the electro-magnet is not energized)

1 when the second signal from the slotted disk passes (confirmation that the electro-magnet is not energized)

0 when the third signal from the slotted disk passes (energization of the electromagnet)

0 when the fourth signal from the slotted disk passes (confirmation that the electromagnet is energized)

0 when the following signals from the slotted disk pass.

If the binary 0 state is assigned to the state of the sensor 24 when its associate print wheel is stopped in the print position (no beam passes in the example chosen), the binary 1 state is assigned to the state of the sensor 24 when it receives the beam. Diagram E shows the states of the sensor 24 which when modulated by an associated wheel 19, passes successively through states 0 and 1. This change of states for a print wheel which rotates without any fault is made possible by exact synchronization with the signals delivered by the slotted disk 13 (diagram A).

By observing the state of the sensor 24 energized by an associated wheel 19 at each instant when the sensor 14 of the rotating slotted disk produces a 1 state, it is possible to know whether the print wheel is rotating (1 state) or whether it is stopped (0 state). Since the time for observation must be therefore determined by a unit which delivers a signal during the time when the sensor 24 of a rotating associated wheel 19 is in the 1 state, this signal may be supplied by a sensor associated with a second slotted disk integral with the drive shaft of the print wheels. However, to avoid installing too many sensors, it may be advantageous to use one of the wave fronts of the signal supplied by the sensor 14 energized by the slotted disk 13 already used to determine the instant of control of the electromagnet 16.

This solution is more economical, but it does not allow detection of misprints caused by closing a slot of the slotted disk 13. However, this solution is discussed in the following part of the description.

Further, between the electro-magnet's order (diagram B) and the instant when a print wheel 11 actually stops, there is a time period t which is equal to the time it takes for the system to respond to the order given (diagram D: wheel rotating: 1 state; wheel stopped: 0 state). The disposition of the components must evidently be formed in such a way that the instant at which the state of the sensors is sampled is after the instant at which all the wheels which have been ordered to stop cease to rotate. Said response time may vary according to the type of printer; generally, however, it is not longer than the time between two successive signals according to diagram A from slotted disk 13. For example, the wheel controlled by the third signal stops between the third and fourth signals from the slotted disk 13. One advantageous embodiment of a printer which uses the coincidence search method has components so determined that a wheel which has been ordered to stop does not fail to stop when a wave front of the signal which comes from the slotted disk passes, said signal corresponding to the order to stop the wheel in the following position. In the example chosen, said disposition leads to reading the state of the sensor 14 when the rising wave front of the fourth signal of the slotted disk 13 passes to check that the wheels stop in the third position.

In the above configuration, and with the previously chosen binary conventions, the state of the coincidence search sensor 24 is, in the example where the wheels stop in the third position:

1 when the first signal of the slotted disk 13 passes 1 when the second signal of the slotted disk passes 1 when the third signal of the slotted disk passes 0 when the fourth signal of the slotted disk passes 0 when the following signals of the slotted disk pass.

Checking proper operation of the printer therefore amounts to comparing the state of the electromagnet (diagram B) of a print wheel 11 at the nth pass of the signal which comes from the slotted disk 13 with response (diagram E) of the sensor 24 actuated by the associated wheel 19 at the n+1th pass of the signal A which comes from the slotted disk 13.

This way of using the signals supplied by the sensor which is made to operate by the associated wheel 19 is evidently not the only way, and it is therefore given only by way of explanation. One possibility is simply to count the changes in state of said sensor and to compare them with a reference signal which is kept in a memory (diagram C) or to count the passes from 0 to 1 of the state of the sensor and to compare them with a reference signal from unit 30. At a determined observation instant, the state of the sensor may be tested, the number of 1 states during the cycle may be tested and the result may be compared with a reference signal. These non-limiting examples show that various logic uses may be envisaged for processing the signals supplied by the sensor.

The following part of the description relates to a logic embodiment which uses the principle of comparison of the states of the control pulses of electromagnets with the responses of the sensors at a delayed observation instant such as described hereinabove.

For each print wheel, there is a memory register 29 which has a number of divisions 1 to k equal to the number of positions, said data, e.g. 1,1,1,0,0, . . . 0, being stored by write-in starting from a reference unit 30 which may be a computer or a keyboard.

In the case of the examples chosen, the operations are carried out as follows:

Beginning of the cycle:

state 1 command to the electro-magnet. Storing of the 1 state in division 1 of memory 39 (diagram C, first line).

1st signal:

state 1 command to the electro-magnet (diagram B). Storing of the 1 state in division 2 of memory 29 (second line of diagram C), comparison between the state of the sensor and the contents of division 1 of memory 29 (diagram C). Both signals should be in the 1 state, and the output of comparator 36 should be 0.

2nd signal:

state 1 command to the electro-magnet for the output of comparator 36 (diagram F) to continue in the 0 state. Storing of the 1 state in division 3 of the memory; comparison between the state of the sensor 24 and the contents of division 2 of the memory 29 (diagram C). (Both signals should be in the 1 state).

3rd signal:

state 0 command to the electro-magnet. Storing of the 0 state in division 4 of the memory; comparison between the state of the sensor 24 (diagram E) and the contents of division 3 of the memory 29 (diagram C). (Both signals should be in the 1 state); so the output of comparator 36 should remain 0.

4th signal:

state 0 command to the electro-magnet. Storing of the 0 state in division 5 of the memory. Comparison between the state of the sensor 24 (diagram E) and the contents of division 4 of the memory 29 (diagram C). (Both signals should be in the 0 state to maintain the output of comparator 36 at 0.

Following signals:

Comparison (diagram F) should give identical results to those obtained at the 4th signal.

A fault would result in a difference between the memory division signal and the signal of the coincidence search sensor 24, causing the output of comparator 36 to change to state 1.

Example of a fault:

Fault G (wheel 11 does not rotate mechanically):

The coincidence search sensor 24 (diagram EG), which should be in the 1 state at the instant of the rising wave front of the second signal from slotted disk 13, is at 0, showing that a wheel is stopped, whereas it should be rotating. The comparator 36 (diagram FG) shows a change to state 1.

Fault H (wheel 11 does not stop):

A 1 state from the coincidence search sensor 24 (diagram EH), which should be in the 0 state, indicates that a wheel is rotating whereas it should be motionless. Comparator 36 (diagram FH) indicates a change in state.

I claim:

1. A printer including a drive shaft, a plurality of parallel print wheels mounted in overriding relation on the drive shaft; each print wheel having a multiplicity k of printing positions spaced around the periphery thereof; individual electro-magnet latch means for stopping the rotation of each print wheel at an ordered printing position; means for controlling each latch means to stop its corresponding print wheel in response to an order signal; means for sensing angular positions of the drive shaft corresponding to each printing position of the print wheels; a plurality of parallel auxiliary wheels; means for mounting each auxiliary wheel for rotation about an axis parallel with the drive shaft and in meshing engagement with a corresponding print wheel; means for detecting angular positions of each auxiliary wheel corresponding to the printing positions of its print wheel; and means for comparing the detected angular position of each auxiliary wheel after actuation of the latch means of its associated print wheel with the print wheel position order signal, wherein said means for detecting the angular position of the auxiliary wheels comprises:

a fixed tubular shaft parallel to the drive shaft and rotatably supporting the auxiliary wheels, said tubular shaft having a plurality of axially-spaced radial apertures, one aperture for each auxiliary wheel;

a plurality of radiation emitters disposed inside said tubular shaft in alignment with said apertures;

a plurality of receivers sensitive to the radiation from said emitters, each receiver being disposed outside an auxiliary wheel in alignment with a respective aperture and emitter; and each auxiliary wheel having a plurality of angularly spaced circumferential portions which are opaque to radiation from said emitters alternating with an equal plurality of portions which are transparent to said radiation, one of the plurality of either said opaque or transparent portions being in registry with the line between the respective emitter and receiver when the corresponding print wheel is stopped at each printing position.

2. A printer according to claim 1 wherein said radiation emitters are disposed on a printed circuit strip.

3. A printer according to claim 1 wherein said radiation receivers are disposed on a printed circuit strip in a line parallel to said tubular shaft.

4. A printer according to claim 1 wherein said means for controlling each latch means to stop its corresponding print wheel in response to an order signal comprises:

a memory having k divisions corresponding to the k printing positions of a print wheel;

means for entering a printing position stop order for said print wheel in the corresponding division of said memory;

a double electronic switch having a first circuit for reading divisions of the memory in numerical sequence and a second circuit for simultaneously reading a lower numbered division of the memory than that being read by the first circuit; and control means responsive to a stop order read by said first circuit to actuate the corresponding latch means to stop the print wheel.

5. A printer according to claim 4 wherein said means for comparing the detected angular position of each auxiliary wheel after actuation of the latch means of its corresponding print wheel with the print wheel position order comprises:

means for comparing a stop order read by said second circuit with a position signal from said means for detecting the angular position of the corresponding auxiliary wheel, the difference between the memory division read by the second and the memory division read by the first circuit of the electronic switch being preselected to compensate for mechanical actuation delay of the latching means.

6. A printer according to claim 5 wherein each division read by the second circuit is next adjacent to the division being read simultaneously by the first circuit.

* * * * *

UNITED STATES PATENT AND TRADEMARK OFFICE

CERTIFICATE OF CORRECTION

PATENT NO. : 4,350,092

DATED : 21 September 1982

INVENTOR(S) : Christian GENEY

It is certified that error appears in the above—identified patent and that said Letters Patent is hereby corrected as shown below:

Column 4, line 8: after "and" insert --there is--.

Column 5, line 50: after "which" insert --,--.

Signed and Sealed this

*Fifteenth* Day of *February 1983*

[SEAL]

*Attest:*

GERALD J. MOSSINGHOFF

*Attesting Officer*

*Commissioner of Patents and Trademarks*